US005436687A

United States Patent [19]

Crider et al.

[11] Patent Number: 5,436,687

[45] Date of Patent: Jul. 25, 1995

[54] COMBINATION DEVELOPER/ABSORBER PACKAGE

[75] Inventors: Albert Crider, Belleville; Norman Michlin, Bloomfield Hills, both of Mich.

[73] Assignee: Universal Developer and Manufacturing Company, Dearborn, Mich.

[21] Appl. No.: 183,127

[22] Filed: Jan. 18, 1994

[51] Int. Cl.[6] ..... G03D 7/00

[52] U.S. Cl. ..... 354/300; 354/316; 95/128; 95/901; 96/151

[58] Field of Search ..... 354/300; 355/100, 106, 355/27; 55/70, 71, 316, 387; 206/216

[56] References Cited

U.S. PATENT DOCUMENTS 4,303,329 12/1981 Michlin ..... 354/300

4,397,663 8/1983 Michlin et al. ..... 55/387

*Primary Examiner*—D. Rutledge

*Attorney, Agent, or Firm*—Gifford, Krass, Groh, Sprinkle, Patmore, Anderson & Citkowski

[57] ABSTRACT

A combination developer/absorber package for use in a diazo copy machine. The package includes a hollow package body having a vapor permeable top and bottom. A vessel of liquid ammonia is nested inside the interior of the package body and has an opening which is closed by a stopper having two bores formed therethrough. Supply and exhaust tubes extend through the bores and into the vessel for quick connection with the supply and exhaust lines of the diazo copy machine. A quantity of ammonia vapor absorbent material is disposed inside the package body between the vessel of liquid ammonia and the side wall of the container body. The package sits on top of a blower unit operatively associated with the machine so that warmed, ammonia vapor laden air passes through the absorbent material.

4 Claims, 1 Drawing Sheet

FIG-1
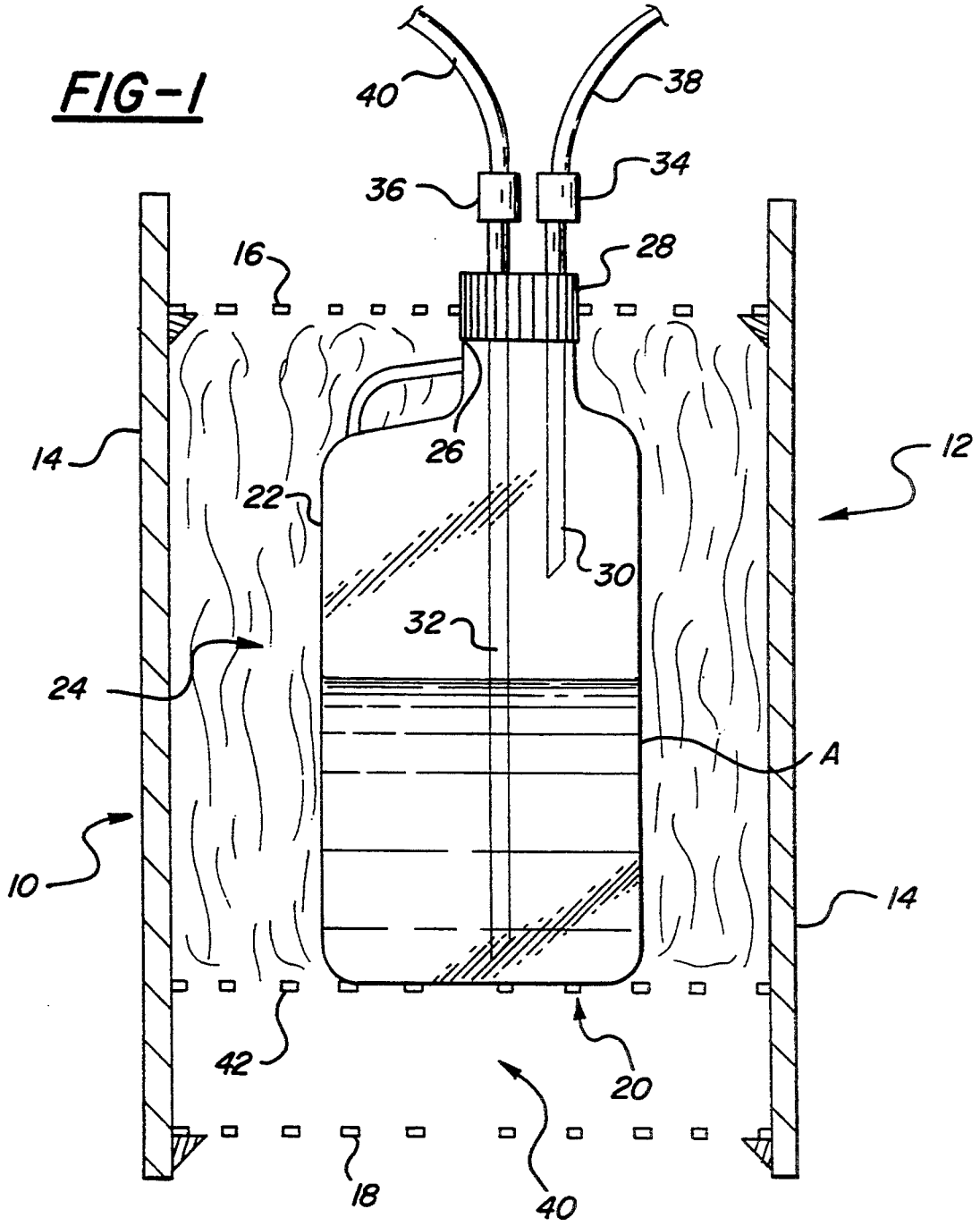
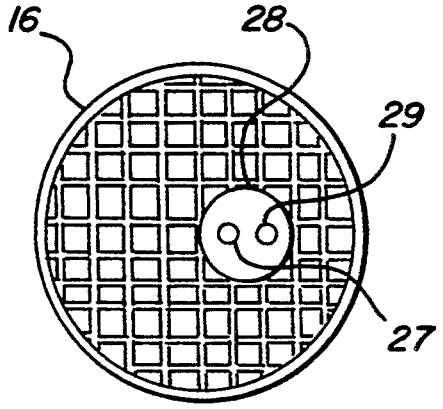
FIG-2

COMBINATION DEVELOPER/ABSORBER PACKAGE

FIELD OF THE INVENTION

This invention concerns the field of diazo copy machines and, more particularly, a modular unit containing both developer and absorber which may be quickly installed and removed.

DESCRIPTION OF THE RELEVANT PRIOR ART

Diazo type copy machines require a source of developer vapor in order to develop exposed diazo paper. A common arrangement for such machines is the provision of a container of ammonium hydroxide liquid through which air is circulated from a developer chamber included in the machine and supplied to a pair of tubes, one of which is disposed within the liquid level and the other above the liquid level such that air from the developer chamber passes through the longer length tube, bubbles through the liquid and exits through the shorter length tube into the developer chamber via connecting flexible lines. This process provides a source of water and ammonia vapor for the developer chamber, the presence of which achieves the development of the exposed prints.

It is common to provide the developer machine with a gassing chamber in which suction is developed to draw off the ammonia vapors emanating from the developer paper after it passes through the developer chamber to eliminate or reduce the ammonia vapor smell from the copies. The air and vapors in the gassing chamber are exhausted by means of a blower unit, either to the outside of the room or building or, more commonly, through an absorber canister so as to allow direct exhaust into the room, thus obviating the need for extensive exhaust hookups for operation of the machine.

Such containers of developer liquid periodically become exhausted of the ammonia content requiring replacement. Similarly, the absorber canisters eventually become saturated, losing their absorptive powers and require replacement. The absorber canister typically comprises container within which is disposed an absorber material such as activated charcoal.

In U.S. Pat. No. 4,303,329, there is disclosed a diazo copy machine having a particular ammonia vapor absorber in which a particular absorber material is disposed. The physical configuration of the canister is such that the exhaust from the gassing chamber is introduced at one end of the absorber canister and exits at the other end, the canister being disposed in a generally horizontal position.

U.S. Pat. No. 4,397,663 discloses a self-contained disposable package which houses a container of developer liquid as well as an ammonia vapor absorber canister. The developer container is adapted to be readily hooked up to the developer chamber supply and exhaust lines, and the absorber canister connected to the exhaust from the blower unit associated with the machine; generally the blower unit is free standing and is attached to the gassing chamber by a length of hose or tubing. The air exhausted from the copy machine by the blower is typically warm. The potential packaging consists of a fiberboard carton in which is received a container of ammonia developer solution and the canister of absorber materials, (disclosed as activated charcoal and excelsior saturated with phosphoric acid). The absorber materials are disposed in a separate paperboard box defining a canister disposed within the partition, closed off at the top end by a cap formed with an array of breather openings, and a central guide opening receiving a flow tube adapted to be connected to the gassing chamber exhaust.

The flow tube extends downwardly through the absorber materials and is seated on a support at the bottom of the tube. The bottom support is adapted to position the end of the tube to allow the exhaust from the gassing chamber to pass down the length of the tube and pass out through the tube ending, back upwardly through the absorber materials and out through the breather openings of the cap.

This arrangement enables a convenient top connection to a vertically oriented absorber canister housed within a carton, while the absorber material composition and vertical orientation thereof minimize the tendency for the occurrence of channelization in the absorber materials.

The disposable packaged disclosed in U.S. Pat. No. 4,397,663 has proved to be a convenient and low maintenance way of supplying both developer and absorber to a diazo type copy machine. However, the patented disposable package does have some disadvantages. In particular, the package is not truly modular and self-contained since, as can readily be seen by examining FIG. 1 of the specification, the package really includes two separate units (the absorber cartridge and the developer supply) which are merely placed side by side inside a fiberboard carton. In use, the two units generally are removed from the carton and separated, the absorber canister being set upon the blower and the developer container placed elsewhere. Moreover, the absorber unit disclosed in the patent includes central flow tube 54 which is affixed to a length of flexible tubing 64 attached to the blower exhaust outlet. Thus, the installation of the patented package is both somewhat difficult, and also requires special fittings.

What is needed is a truly modular, truly self-contained absorber/developer package which may be used as a single unit, and which may be easily set up for use with a diazo copy machine. What is also needed is such a package which is easy and inexpensive to manufacture, and which may be used with the machine without the use of special fittings.

SUMMARY OF THE INVENTION

The invention described and claimed herein has been designed to overcome the deficiencies in the prior art noted above. The invention is a combination developer-/absorber package for use in a diazo type copy machine. The package comprises a hollow package body having at least one side wall and a vapor permeable top and bottom joined thereto. Typically, the package body will be cylindrical in form, although it could be square or rectilinear. A developer supply container is disposed in the interior of the package body. Surrounding the developer supply container is a quantity of ammonia vapor absorbent material.

The developer supply container includes a vessel for containing a quantity of liquid ammonium hydroxide therein. The container, which is generally in the form of a jug, has a top opening. The developer supply container also includes a stopper for closing the vessel opening. The stopper includes a pair of through bores formed therein. A first supply tube extends through one of the through bores and for a short distance into the vessel to terminate above the level of the liquid ammonia. A second exhaust tube extends through the other of the bores for a longer distance into the vessel so that it contacts the liquid ammonia.

The ammonia vapor absorbent material is disposed in the package so that it surrounds the vessel of liquid ammonium hydroxide. As mentioned before, both the top and bottom of the package are permeable to vapor. Thus, the package may be placed so that it rests upon the blower exhaust outlet. Warm, ammonia vapor laden air exhausted from the copy machine via the exhaust blower will pass through the vapor permeable bottom of the package of the present invention, thus coming into contact with the quantity of ammonia vapor absorbent material contained therein. This material will absorb the warmed ammonia vapors so that the degassed air will then pass through the vapor permeable top of the package and, thenceforth, out into the atmosphere. Because the vapor laden air passing through the absorber material is warm, the absorbing action is enhanced.

In a preferred embodiment of the device of the present invention, the flow of air through the package is improved by including a substantially empty chamber disposed inside said package and proximate the bottom thereof. Of course, this embodiment contemplates that a vapor permeable partition will be provided between the empty chamber and the remainder of the interior of the package containing the vessel of ammonia and ammonia absorbent material.

Typically, the top and bottom of the package, and the partition if included, will be formed of a mesh type of material, such as screening or plastic mesh. Alternatively, these elements may be formed of solid sheet material (such as paper, cardboard, plastic, etc.) having a plurality of perforations formed therethrough.

In one preferred embodiment of the package of the present invention, a pair of quick connects are provided on both the first and second flow tubes so that the tubes may be easily connected with and disconnected from, respectively, the supply and exhaust lines from the developing chamber of the diazo copy machine. This feature contributes to the safe operation of the machine Since the opportunity for ammonia from the container to leak into the room is minimized.

BRIEF DESCRIPTION OF THE DRAWINGS

The following detailed description is best understood by reference to the following drawings in which:

FIG. 1 is a side view of the package of the present invention showing the package body in cross section; and FIG. 2 is a top view of the top of the package body with the vessel connector in place.

DETAILED DESCRIPTION OF THE PREFERRED EMBODIMENT

Throughout the following detailed description like numerals are used to reference the same elements of the invention shown in multiple figures therein. Referring now to the drawings, and in particular to FIG. 1, there is shown a combination developer/absorber package 10 for use in a diazo copy machine (not shown). The package 10 includes a hollow package body 12 having at least one side wall 14 and a vapor permeable top 16 and bottom 18 joined to said side wall 14. A developer supply container 20 includes a vessel 22 disposed inside the interior of the package body 12. Vessel 22 contains a quantity of liquid ammonia A therein. A quantity of ammonia vapor absorbent material 24 is also disposed inside the interior of package body 12 such that it substantially surrounds the vessel 22.

The developer supply container 20 further includes an opening 26 formed at the top of the vessel 22 and a stopper 28 which closes the opening 26. As can most clearly be seen in FIG. 2, the stopper 28 has a pair of through bores 27, 29 formed therein. An example of a closure which may be used to stopper the opening of the vessel is disclosed in U.S. Pat. No. 4,080,989. A pair of tubes including a first inlet tube 30 and a second exhaust tube 32 extend through the pair of through bores 27, 29. The supply tube 30 extends into the vessel 22 for a relatively short distance to terminate above the level of the liquid ammonia A. The second exhaust tube 32 extends into the vessel 24 for a longer distance so that it contacts the quantity of liquid ammonia A. Air exhausted from the developer chamber of the copy machine is bubbled through the liquid ammonia A, thus causing the air above the level of the ammonia A to become saturated with ammonia and water vapor. The ammonia and moisture vapor laden air is drawn out through the supply tube 30 and subsequently through the developer chamber supply line 38. Preferably, a quick connect 36 (well known in the prior art) is used to connect supply tube 30 with supply tube 38 so that the package of the present invention may be easily and quickly installed into and removed from a diazo copy machine. Similarly, another quick connect 36 is used to connect exhaust tube 32 and the developing chamber exhaust line 40 of the diazo copy machine.

The quantity of absorber material 24 preferably takes the form of a mixture of excelsior and granular activated charcoal with a phosphoric acid treatment for both of these compositions. This mixture provides a very effective absorption of the ammonia laden vapor and resists channelization due to the mixture of fibrous and granular absorber materials.

In use, the package 10 is placed upon the top of the copy machine's blower unit exhaust fan so that the warm flow from the copy machine gassing chamber passes through the vapor permeable bottom 18 of the package body 12. Quick connects 36 are used to quickly hook up the supply exhaust tubes and lines, thus minimizing smells and safety risks associated with escaping ammonia vapors. In the embodiment shown in FIG. 1, a substantially empty chamber 40 is provided adjacent the bottom 18 of the package body 12 to improve the air flow through the interior of the package body 12. Thus, a partition 42, also comprised of a vapor permeable material, is provided to define the chamber 40.

After flowing through the bottom 18, chamber 40 and partition 42, the warm, vapor laden air from the blower then flows upwardly through blower mass 24 of absorbent material which absorbs substantially all of the ammonia vapor. The degassed air then flows outward through the vapor permeable top 16 after the ammonia vapors have been absorbed.

The quantities of liquid ammonia A and absorber material 24 are correlated such that, as soon as the copy machine exhibits poor copy development, the entire package 10 is replaced since the absorber materials will be substantially exhausted. This simplifies the maintenance chores associated with achieving proper operation of the copy machine. Furthermore, the concentric arrangement of the liquid ammonia vessel and the quantity of absorber material provides for a truly self-contained, modular unit; the entire unit is used in a single location.

Accordingly, it is very simple to replace and install the combination developer/absorber package of the present invention. The quick connects are disconnected to release the supply and exhaust tubes from the supply and exhaust lines of the machine. The unit is simply lifted off of the blower and replaced with a new unit. The quick connects then allow quick reconnection of the supply and exhaust tubes with the supply and exhaust lines of the machine.

The package 10 of the present invention can take other configurations then the exact design depicted and may be constructed of a wide variety of differing materials within the scope of the present invention. For example, the quantity of absorber material may be disposed is a self-contained cartridge configured as an annular ring which is then inserted into the cartridge body, with the ammonia vessel being placed into the central aperture of the cartridge. Also, as mentioned previously, the configuration of the package body may be other than cylindrical. Furthermore, a fitting may be provided on the bottom of the package body for connection to the exhaust line of a diazo copy machine. Other arrangements of the elements of the present invention may occur to one skilled in the art without departing from the scope of the claims appended thereto. It is these claims, and all reasonable equivalents thereof, rather than the exact exemplifications and embodiments depicted herein, which define the true scope of the present invention.

We claim:

1. A combination developer/absorber package for use in a diazo copy machine, said package comprising:

a hollow package body having at least one side wall and a vapor permeable top and bottom joined to said side wall;

a developer supply container disposed within the interior of said package body and including:

a vessel for containing a quantity of liquid ammonium hydroxide therein and including an opening near the top thereof;

a cap for closing said opening and including a pair of through bores formed therein;

a supply tube extending through one of said bores and into the interior of said vessel for a short distance to terminate above the level of said liquid ammonia; and an exhaust tube extending through the other of said bores and into the interior of said vessel for a longer distance to contact said liquid ammonium hydroxide; and a quantity of ammonia absorbent material disposed within the interior of said package body and surrounding said vessel of said liquid ammonium hydroxide such that air flow containing ammonium vapor may pass through said vapor permeable bottom of said package body, upward through said quantity of ammonia vapor absorbent material and out said vapor permeable top.

2. The package of claim 1 further comprising a substantially empty chamber disposed proximate said bottom of said package body to improve air flow therethrough.

3. The package of claim 2 further comprising a vapor permeable partition disposed between said substantially empty chamber and a remainder of the interior of said package body.

4. The package of claim 1 further comprising a pair of quick connects provided on said supply tube and said exhaust tube for quick connection with, respectively, supply and exhaust lines of a developing chamber of a diazo copy machine.

* * * * *